United States Patent [19]

Sharber

[11] Patent Number: 4,457,088

[45] Date of Patent: Jul. 3, 1984

[54] CALENDAR HOLDER

[75] Inventor: Jerry L. Sharber, Toledo, Ohio

[73] Assignee: Sheller-Globe Corporation, Toledo, Ohio

[21] Appl. No.: 518,978

[22] Filed: Aug. 2, 1983

Related U.S. Application Data

[63] Continuation of Ser. No. 417,090, Sep. 13, 1982, abandoned.

[51] Int. Cl.[3] ..... G09D 3/04

[52] U.S. Cl. ..... 40/120

[58] Field of Search ..... 40/120, 119, 376, 404, 40/403, 389, 390

[56] References Cited

U.S. PATENT DOCUMENTS

| | | | |
|---|---|---|---|
| 1,041,923 | 10/1912 | Weeks | 40/120 |
| 1,049,428 | 1/1913 | Weeks | 40/120 |
| 1,566,054 | 12/1925 | Weeks | 40/120 |
| 1,927,131 | 9/1933 | Middleditch | 40/120 |
| 2,835,058 | 5/1958 | Ray | 40/120 |

FOREIGN PATENT DOCUMENTS

| | | | |
|---|---|---|---|
| 374048 | 6/1907 | France | 40/120 |

*Primary Examiner*—John J. Wilson

*Attorney, Agent, or Firm*—Fraser, Barker, Purdue & Clemens

[57] ABSTRACT

The present invention relates to a calendar holder having a unique construction which permits all components of the holder to be manufactured of a plastic material. The holder includes an inclined support platform adapted to support a pair of spaced apart arches. Each arch is of a generally inverted U-shape and includes two legs which are inserted into apertures formed in the platform. One of the legs is provided with a lower threaded end and a radially extending lip immediately above the threaded end. The radial lip is received into an annular recess formed in the upper surface of the platform about one of the apertures. The radial lip functions both as a stop member to control the height of the respective arch and as a stabilizer for supporting the arch on the platform. A retaining nut is fastened to the threaded end of the one leg to secure the arch to the platform.

2 Claims, 3 Drawing Figures

CALENDAR HOLDER

This application is a continuation of Ser. No. 417,090, filed 09/13/82, and now abandoned.

BACKGROUND OF THE INVENTION

The present invention relates generally to an arch-type document holder and, in particular, to a document holder of the type commonly employed as a desk top calendar holder.

The popularity of the day-to-day desk top calendar holder has increased at a steady rate. Such calendar holders are available in a wide variety of designs. While some calendar holders are constructed entirely of metal, others often include plastic or wood components. The wide range of materials and construction techniques employed have resulted in calendar holders of varying quality in several price ranges.

SUMMARY OF THE INVENTION

The present invention relates to an arch-type document holder which can be utilized as a calendar holder. The holder has a unique construction which permits all components of the holder to be fabricated of a plastic material. Such a construction substantially reduces the manufacturing costs associated with the holder.

The document holder comprises a generally planar support platform provided with a pair of spaced apart apertures. The platform is adapted to support a stacked array of papers in which each sheet of paper has at least one aperture formed therein. The stacked array of papers can be, for example, a 365-day calendar.

The holder also comprises a guide means for insertion into the apertures formed in the papers. The guide means includes a generally inverted U-shaped member having one leg which is inserted into one of the apertures formed in the platform, and another leg which is inserted into the other one of the apertures formed in the platform. One of the two legs is provided with a stop member engageable with the upper surface of the platform for controlling the height of the guide means relative to the support platform. Fastening means are provided for maintaining the stop member in engaging relationship with the platform.

Among the objects of the invention is to produce an arch-type document holder which may be readily and economically manufactured.

Another object of the invention is to produce an arch-type document holder which may be manufactured and shipped in an unassembled condition.

Still another object of the invention is to produce an arch-type document holder which may be assembled and disassembled with facility.

Another object of the invention is to produce an arch-type document holder which is simple in construction and extremely rigid in assembled form.

BRIEF DESCRIPTION OF THE DRAWINGS

The above, as well as other objects and advantages of the invention, will become manifest to one skilled in the art from reading the following detailed description of an embodiment of the invention when considered in the light of the accompanying drawings in which.

DESCRIPTION OF THE PREFERRED EMBODIMENT

Figure 1:
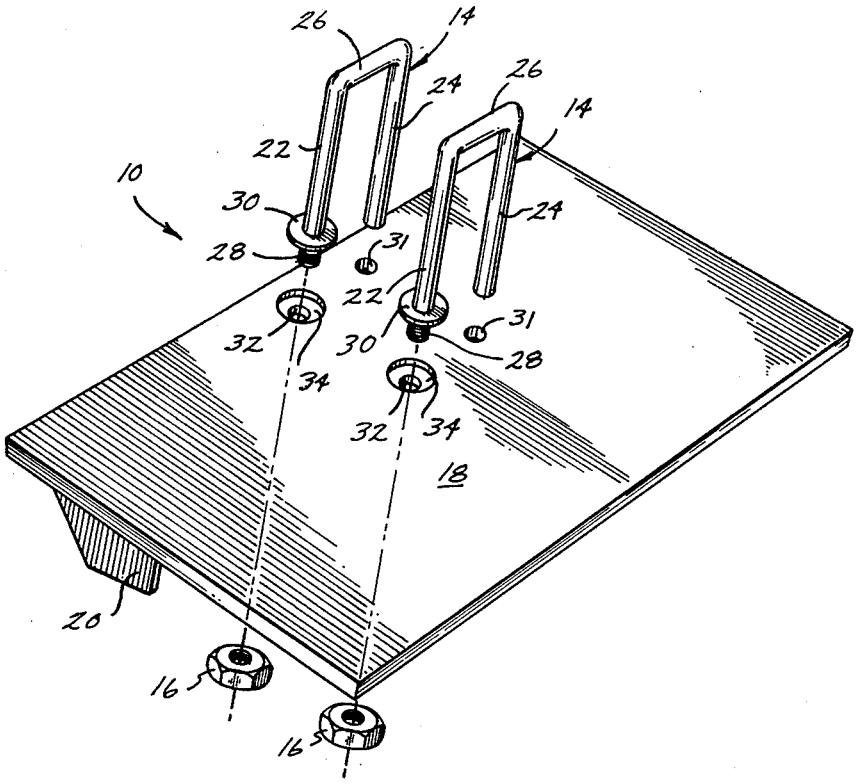
FIG. 1 is an exploded perspective view of a calendar holder embodying the principles of the present invention.
Figure 2:
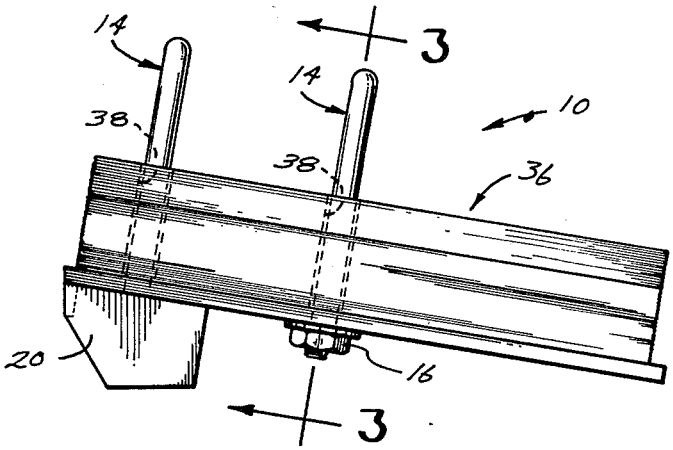
FIG. 2 is a side plan view of the assembled calendar holder shown in FIG. 1.

Referring to the drawings, there is shown a calendar holder 10 embodying the principles of the present invention. It should be noted at the outset of this description that, while the present invention is described as calendar holder, the holder can also be utilized for supporting stacks of documents, records, and the like, other than calendars.

The calendar holder 10 includes a support platform 12, a pair of spaced apart arches 14, and a pair of associated retaining nuts 16. The platform 12 includes a generally planar upper support surface 18 and a pair of spaced apart downwardly extending legs 20. The legs 20 maintain the upper surface 18 in an inclined position when the platform 12 is resting on a horizontal supporting surface such as a desk top, for example.

Each of the arches 14 is of a generally inverted U-shape and includes a pair of downwardly extending legs 22 and 24 having their upper ends connected by a web portion 26. The legs 24 are of a generally uniform diameter through their entire length, while the legs 22 are each provided with a lower threaded portion 28. The legs 22 are also each provided with a radially extending annular lip 30 formed immediately above the threaded portion 28.

Figure 3:
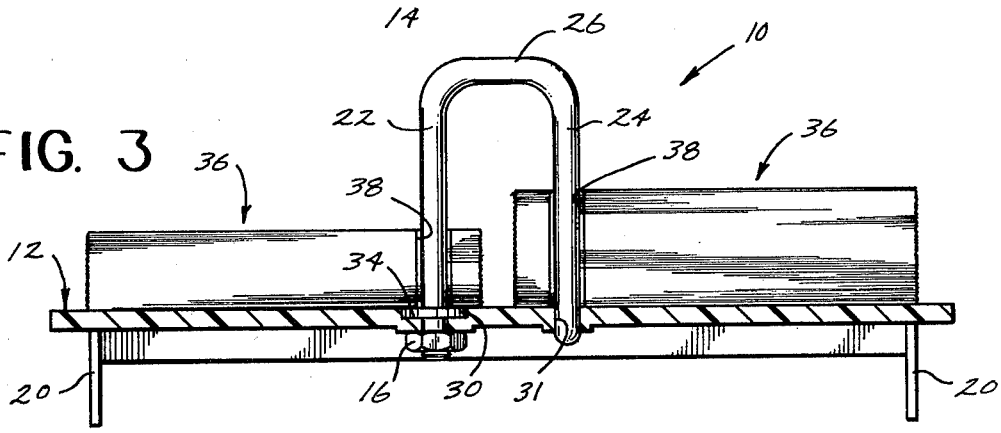
FIG. 3 is a sectional view of the calendar holder taken along the line 3—3 of FIG. 2.

The extreme lower ends of the legs 24 are adapted to be received within a pair of spaced apart apertures 31 formed in the platform 12, while the lower threaded portions 28 of the legs 22 are adapted to extend through a pair of spaced apart apertures 32 formed in the platform 12. The platform 12 is provided with a pair of annular recesses 34 formed in the upper support surface 18 about each of the apertures 32 for receiving the radial lip 30 of each leg 22. Typically, the recesses 34 are formed with a depth approximately equal to the thickness of the radial lip 30 such that the upper support surface 18 and the upper surface of lip 30 are substantially coplanar, as shown in FIG. 3. The retaining nuts 16 are utilized to secure the arches to the platform and effect a surface-to-surface contact between the bottom and side wall of the lip 30 with the associated surfaces of the annular recesses 34. The structural relationship results in an unexpectedly sturdy support for the arches 14 and militates against relative movement between the arches 14 and the associated platform 12.

Generally, before the arches 14 are secured to the platform 12, a stacked array of papers, such as calendar sheets 36, are positioned on the support surface 18 of the platform 12. The calendar sheets 36 are typically each provided with a pair of apertures 38 spaced apart a distance corresponding to the distance between the arches 14.

A document holder having a construction as described above offers several advantages over the prior art. First, such a construction permits all the components of the holder to be manufactured of a plastic material by injection molding, for example. Also, the combination of the radial lip 30 and the threaded fastener 16 provides a simple but effective means for securing the arches to the platform. The radial lip functions both as a stop member for controlling the height of the arches relative to the support surface 18, and also as a stabilizer to securely support the arch on the platform.

In accordance with the provisions of the patent statutes, the principle and mode of operation of the invention have been explained and illustrated in its preferred embodiment. However, it must be understood that the invention can be practiced otherwise than as specifically illustrated and described without departing from its spirit or scope.

What is claimed is:

1. A document holder for supporting a plurality of papers each having at least one aperture formed therein comprising:

a generally planar support platform provided with first and second spaced apart apertures, said first aperture having a predetermined cross section, said platform provided with a recessed portion on the upper surface thereof surrounding said second aperture and an integral boss portion on the lower surface thereof surrounding said second aperture;

at least one guide means for insertion into the aperture formed in the papers, said guide means including a generally inverted U-shaped member having a first leg releasably inserted into said first aperture and a second leg releasably inserted into said second aperture, said first leg having a cross section substantially conforming to the cross section of said first aperture for resisting any lateral movement of said first leg relative to said support platform, said second leg provided with a stop member engaged with said support platform for determining the height of said guide means relative to said support platform, said stop member including a flange portion extending radially from said second leg and securely fastened to said second leg, said flange portion having a lower support surface engaged with said recessed portion formed in the upper surface of said support platform for stabilizing said guide means relative to said support platform and maintaining said second leg in generally perpendicular relationship with the upper surface of said support platform, said flange portion having an upper surface and a thickness approximately equal to the depth of said recessed portion, whereby said upper surface of said flange portion and said upper surface of said support platform are substantially coplanar; and fastening means engageable with the lower end of said second leg and said boss portion of said platform for maintaining said stop member in engaging relationship with said platform.

2. The invention defined in claim 1 wherein the end of said leg having said stop member is provided with a threaded external portion for threaded engagement with cooperating internal threads formed in said fastening means.

* * * * *